US005516160A

United States Patent [19]

Kajuch

[11] Patent Number: 5,516,160

[45] Date of Patent: May 14, 1996

[54] AUTOMATIC DEADBOLTS

[75] Inventor: Pete Kajuch, Brookfield, Wis.

[73] Assignee: Master Lock Company, Milwaukee, Wis.

[21] Appl. No.: 308,409

[22] Filed: Sep. 19, 1994

Related U.S. Application Data

[63] Continuation-in-part of Ser. No. 225,744, Apr. 11, 1994.

[51] Int. Cl.[6] ..... E05C 1/00

[52] U.S. Cl. ..... 292/1.5; 292/337; 292/DIG. 4; 292/DIG. 60

[58] Field of Search ..... 292/1.5, 337, DIG. 60, 292/DIG. 4, 335, 173, 139, 167, 169.14, 169

[56] References Cited

U.S. PATENT DOCUMENTS

| | | | |
|---|---|---|---|
| 3,222,097 | 8/1963 | Behrmann . | |
| 3,872,697 | 3/1975 | Wellekens . | |
| 3,912,309 | 10/1975 | Fischer et al. | 292/335 X |
| 3,933,380 | 1/1976 | Wellekens . | |
| 4,248,452 | 2/1981 | Allenbaugh | 292/167 |
| 4,561,684 | 12/1985 | Marotto . | |
| 4,566,725 | 1/1986 | Klein . | |
| 4,594,864 | 6/1986 | Hart | 292/1.5 X |
| 4,660,871 | 4/1987 | Arakawa et al. | 292/DIG. 4 X |
| 4,671,549 | 6/1987 | Marotto et al. | 292/1.5 X |
| 4,736,973 | 4/1988 | Fang | 292/DIG. 60 X |
| 4,765,663 | 8/1988 | Raymond et al. . | |
| 4,772,055 | 9/1988 | Fang | 292/337 |
| 4,854,619 | 8/1989 | Nakauchi | 292/335 |
| 4,917,416 | 4/1990 | Westphal et al. | 292/DIG. 4 X |
| 4,945,737 | 8/1990 | Hart . | |
| 5,044,182 | 9/1991 | Totten . | |

FOREIGN PATENT DOCUMENTS

| | | | |
|---|---|---|---|
| 232717 | 4/1925 | United Kingdom | 292/335 |

*Primary Examiner*—Rodney M. Lindsey
*Attorney, Agent, or Firm*—Dorn, McEachran, Jambor & Keating

[57] ABSTRACT

An automatic door latch has a case with a bolt movable within the case between a fully extended position in which the bolt extends forwardly of the case, a fully retracted position in which the bolt is within the case, and a partially extended position in which the bolt is positioned to contact a door strike. There is a spring which urges the bolt toward the fully extended position. There is a bolt operator for moving the bolt, against the spring, from the fully extended position toward a retracted position. There is a release mechanism which holds the bolt in the partially extended position and which is effective to release the bolt for movement, under urging by the spring, to a fully extended position, from the partially extended position, upon inward movement of the bolt when it is in the partially extended position.

19 Claims, 3 Drawing Sheets

AUTOMATIC DEADBOLTS

The present invention relates to an automatic deadbolt with adjustable backset and is a continuation-in-part of copending application Ser. No. 08/255,744 filed Apr. 11, 1994.

THE FIELD OF THE INVENTION

The present invention relates to an automatic deadbolt or one which will move to the fully extended position when the door is closed. Such devices principally operate with a trigger mechanism or sensing pin which is separate from the bolt and when such mechanism or pin contacts the door strike, the bolt is released so that it moves from a retracted position into the fully extended position. The addition of a separate trigger mechanism not only adds to the cost of the lock, but further adds complexity to a mechanism which already has a substantial number of interrelated parts. Further, many of the automatic deadbolts in use today require manual reversal by the lock installer because they do not have symmetry for right or left hand door installations.

The present invention utilizes the bolt itself as the means for bolt release to movement into a fully extended and locked position. The bolt has a partially extended position in which it may protrude from the face plate in the door, for example ¼. When the door is moved toward a closed position, the partially extended bolt will contact the door strike, causing the bolt to move inwardly, which operates the release mechanism permitting the bolt to be fully extended when it is in alignment with the opening in the door strike.

In addition, the bolt combines the automatic feature described above with backset adjustment. There is provision for two backset adjustment positions, the commonly utilized 2⅜" and 2¾".

SUMMARY OF THE INVENTION

A primary purpose of the invention is an automatic deadbolt in which the bolt will automatically move to a fully extended position upon door closure.

Another purpose of the invention is an automatic deadbolt in which the deadbolt is partially extended in its normally unoperated position, and upon contact of the deadbolt with the door strike, the deadbolt is released for full extension when it is in alignment with the door strike opening.

Another purpose of the invention is to provide an automatic deadbolt which avoids the use of separate sensing or trigger elements.

Another purpose of the invention is to provide a simply constructed reliable deadbolt which automatically operates upon door closure.

Another purpose of the invention is to provide an automatic deadbolt with adjustment between two backset positions.

Another purpose of the invention is to provide a deadbolt with backset adjustment utilizing a clip element which is effective to hold the deadbolt in either of the two backset adjustment positions.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figures 1, 2:
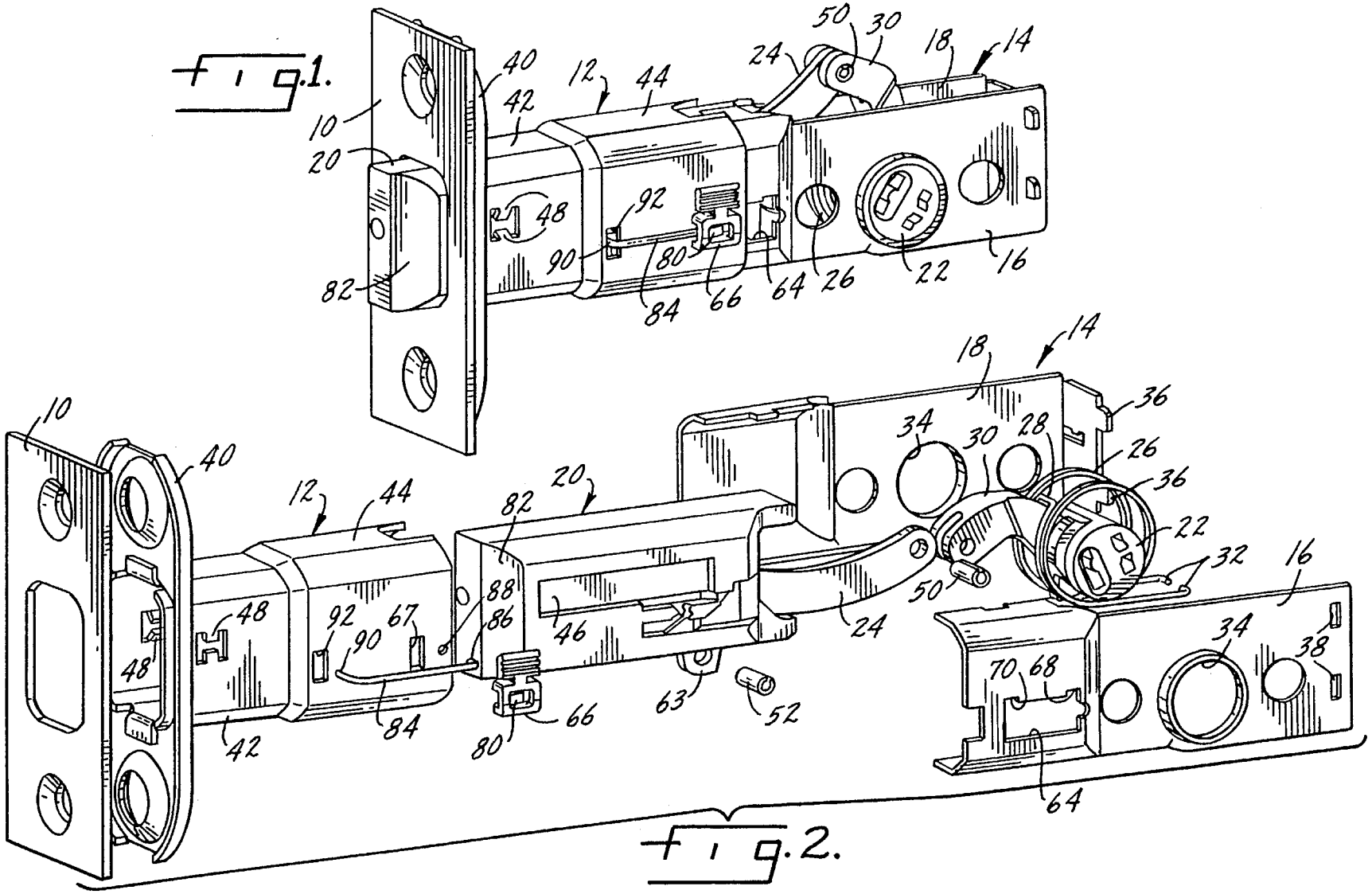
FIG. 1 is a perspective view of the automatic deadbolt of the present invention.
FIG. 2 is an exploded perspective of the automatic deadbolt.

The present invention relates to an automatic deadbolt with adjustable backset. The principles of automatic deadbolt operation disclosed are equally applicable to a deadbolt without adjustable backset. Adjustable backset is an added advantage in today's commercial market to any type of deadbolt and particularly to a deadbolt with automatic operation.

There are a number of automatic deadbolts currently on the market, but all utilize a sensing trigger, normally protruding from the front of the bolt or along its side, to automatically extend the deadbolt when the door is closed. Triggers or sensing mechanisms add cost and complexity to a mechanism which is already complicated. Further, many such triggers require manual reversal by the installer because they lack symmetry for right and left-hand door installation. The present invention provides automatic deadbolt operation when a partially extended bolt makes contact with the door strike mounted in the doorjamb. This causes the bolt to be initially depressed toward the retracted position which operates the release mechanism permitting the deadbolt to fully extend when it is in alignment with the opening in the door strike. The deadbolt is retracted in the normal way by a key, lever or other means.

In the drawings, a face plate is indicated at 10 and will conventionally be mounted at the front of the door frame. There is a front case 12 and a rear case 14 which includes case halves 16 and 18. There is a bolt 20 and a swivel 22 which is connected to the bolt through a link 24. A coil spring 26 encircles the swivel 22 and has a portion 28 which bears against the arm 30 of the swivel, thus urging the swivel in a counterclockwise direction. The spring 26 has a pair of arms 32 which will be positioned on the bottom of the rear case 14 when the case halves are assembled. Thus, the force of spring 26 will normally urge the swivel toward a position in which the bolt 20 is fully extended. The rear case halves 16 and 18 each have an opening 34 for the mounting of the swivel and to provide access to the swivel keyhole. Case half 18 has projections 36 which will extend through aligned openings 38 in case half 16, after which the projections may be staked to secure the case halves into the assembled rear case.

The front case 12 includes a front plate 40, a first front case portion 42 which may be integral with or joined to the front plate 40, and a second front case portion 44 which has a slightly greater cross section than the first front case portion 42. There is an outwardly flared junction between the front case portions 42 and 44.

Movable within the case assembly is bolt 20 which in the fully extended position will project a predetermined distance outwardly from face plate 10 and in the fully retracted position will be fully within the case assembly. The bolt 20 has a longitudinally extending groove 46 along both sides, with the ends of the grooves defining the limits of bolt movement. The front case portion 42 may have inwardly directed projections 48 which ride in the grooves 46 and thus limit the length of inward and outward bolt movement.

The swivel 22 is connected by a pin 50 to link 24. Turning or rotational movement of the swivel, by the use of a key in the keyhole, will cause the link 24 to move between the extended and retracted positions illustrated in the drawings. As described, spring 26 will urge the swivel toward a bolt extended position. The forward end of link 24 is connected by a pin 52 to the bolt 20. Bolt 20 has an open face slot 54 which allows for movement of the link 24 relative to the bolt and the bolt 20 has a closed face slot 56, more particularly shown in FIGS. 6 and 8, which forms a portion of the mechanism connecting the link 24 and the bolt 20. As particularly seen in FIGS. 6 and 8, the slot 56 in which the link 24 rides during movement of the swivel, has a pair of laterally extending grooves 58 in which pin 52 rides during movement of the swivel. The grooves 58 have a closed end 60 on which the connecting pin 52 pivots to retract the bolt, and an open end 62 which permits assembly and is later closed by the bottom surface of front case 12 and the bottom surfaces of rear case halves 16 and 18. The length of the slanted grooves 58 permits a degree of translational movement of the end of the link 24 which carries pin 50.

As is known in the art, backset is the distance between the axis of rotation of the swivel and the front of the latch as defined by the faceplate 10. Backset is adjusted by moving the telescopic rear case 14 relative to the front case 12. The length of backset movement is defined by a slotted opening 64 in one side of the rear case 14 and the inward projections of a plastic backset clip 66 which is mounted in an opening 67 in the front case portion 44. The slot 64 has enlarged end portions 68 and 70 which will receive portions of the clip 66 to hold the telescopic case halves in one of the two adjustable backset positions.

Figures 6, 7, 8, 9, 10, 11:
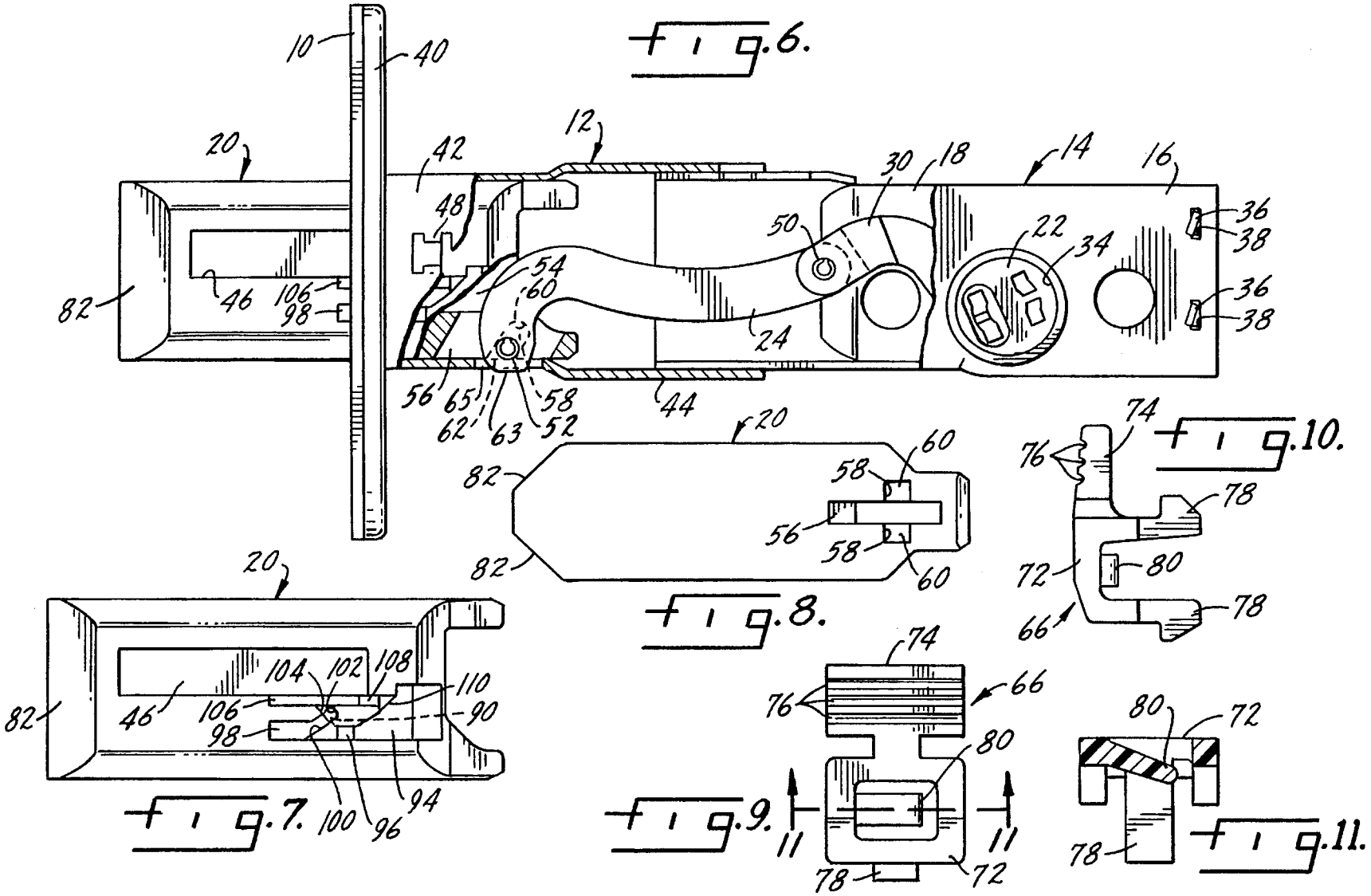
FIG. 6 is a side view, in part section, of the automatic deadbolt.
FIG. 7 is a side view of the bolt.
FIG. 8 is a bottom view of the bolt.
FIG. 9 is a front view of the backset clip.
FIG. 10 is a side view of the backset clip.
FIG. 11 is a section along plane 11—11 of FIG. 9.

The clip 66 is shown in detail in FIGS. 9–11 and has a body 72 and an upwardly extending release arm which has a grooved exterior 76. Extending from the body 72 are a pair of hooks 78 which will extend through the opening 67 in the front case portion 44 to thus mount the clip 66 to the lock assembly. When so mounted, the upper one of the projections 78 will be positioned in one of the slot extensions 68 or 70 to hold the telescopic case halves in one of the two backset adjustment positions. To release clip 66 to change backset, the arm 74 is pushed inwardly causing the upper hook to bend downwardly, permitting release of the clip from the front case portion 44. The clip 66 is completed by a retainer 80 which is used to maintain the deadbolt release mechanism to be described in position on the front case half.

Referring to FIGS. 1 and 2, when the swivel is turned in a counterclockwise direction, under the turning force applied by spring 26, link 24 pivots about the arm 30 of the swivel and moves the bolt in a forward direction. Pin 52 will slide within grooves 58 of the bolt and the forward portion of pin 52 will contact a wall in the bolt grooves 58 to cause forward movement of the bolt. When the bolt has reached a fully extended position, the portion 63 of link 24 will drop down through a front case slot 65 which is aligned with bolt slot 56. The extended ends of the pin 52 in the grooves 58 are restrained by the lower wall of the front case 12 and this locks the bolt in the fully extended position and any force or pressure applied to the end of the bolt will not cause it to be retracted and the bolt will be held in the desired locked position. The cooperation between the grooves 58 in the bolt, the end 63 of link 24, and the slot 65 in the front case is effective to hold the bolt in the fully extended position in all adjusted backset positions.

To retract the bolt, the swivel is turned in a clockwise direction, against the force of spring 26, and its arm 30 rotates in a clockwise direction. The link 24 will initially move up and out of slot 65 in the front case 12 and will then pivot relative to the bolt as pin 52 slides within grooves 58. Continued turning movement of the swivel causes the link 24 to drag the bolt from the fully extended position into a fully retracted position.

Figure 3:
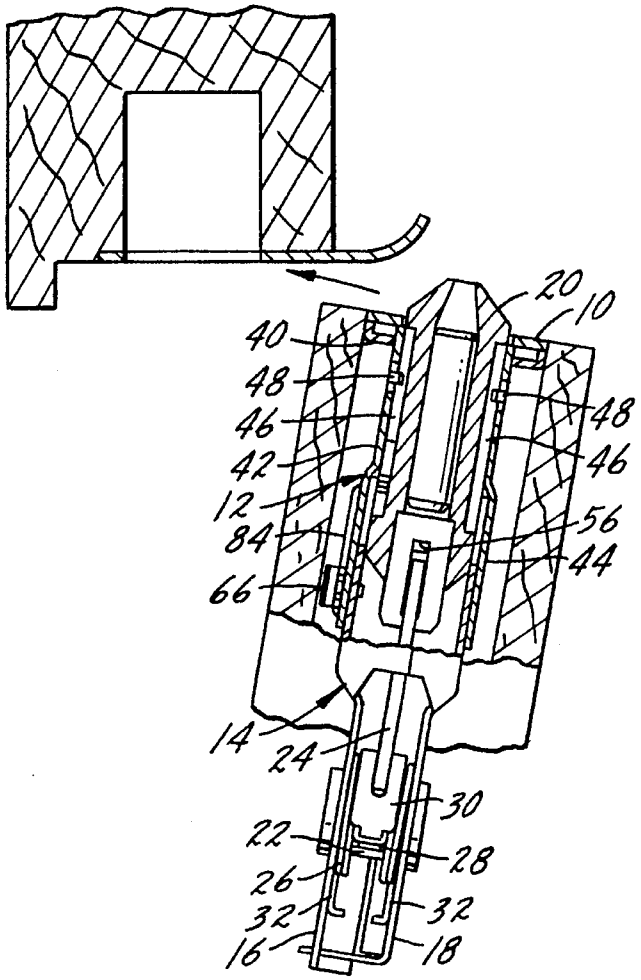
FIG. 3 is a top view of the automatic deadbolt, with portions broken away, illustrating the bolt in the armed position.
Figure 4:
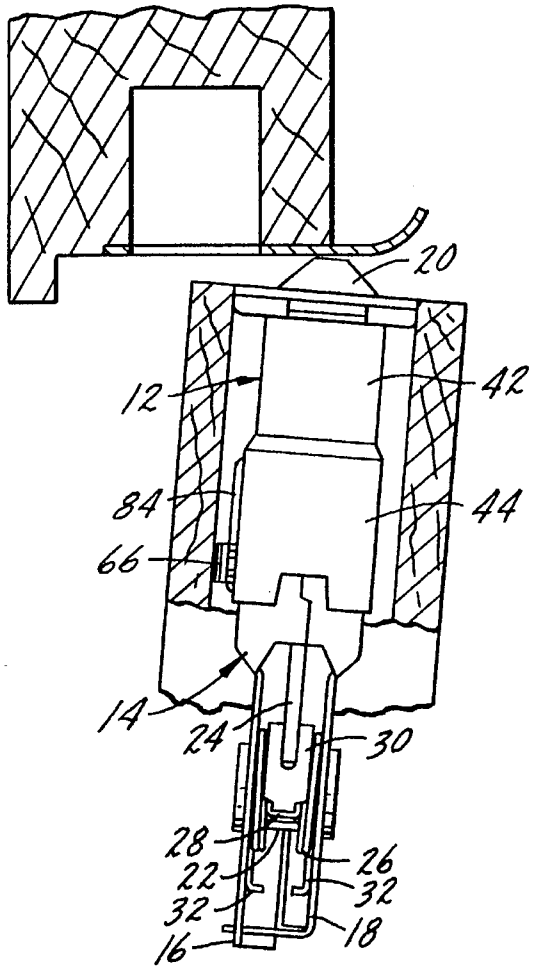
FIG. 4 is a top view, similar to FIG. 3, illustrating bolt movement after contact with the door strike.
Figure 5:
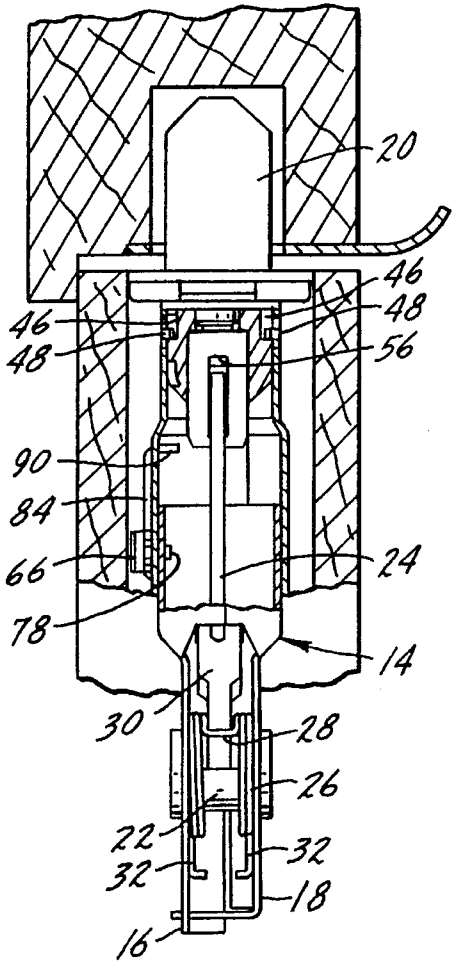
FIG. 5 is a top view similar to FIGS. 3 and 4 illustrating the bolt in a fully extended position.

In order to adjust backset from the maximum extended position shown in FIGS. 3 and 6 to the minimum position shown in FIGS. 1 and 3, the rear case half 14 is telescoped into the front case half 12. The limit of this telescopic movement is defined by slot 64 and its extensions 68 and 70. The inwardly projecting hooks 78 of the backset clip 66 will be positioned within the slot extensions 68 and 70 in either the minimum or backset adjustment positions, with this combination of elements defining adjustable backset.

Bolt 20 is movable between three positions. There is a fully extended position, a fully retracted position, and a partially extended position, in which the nose of bolt 20 as defined by the tapered side walls 82 is extended beyond the faceplate. The purpose in having a partially extended position is so that the bolt may function as the trigger mechanism to cause the bolt to automatically move to a fully extended position when the extended nose contacts the door strike upon closure of the door. The release mechanism for the bolt which both holds it in the partially extended position, and releases it for movement to the fully extended position, includes a catch element or wire or spring 84 having an in-turned end 86 which extends into a hole 88 in the front case portion 44. The wire 84 will pivot about this opening as it moves in manner to be described. The front end of wire 84 has an inward extension 90 which moves within a slot 92 in the front case portion 44. The wire 84 is held in its desired position along the exterior of the front case half by the flexible retainer 80 of the plastic backset clip 66.

As shown particularly in FIG. 7, the bolt 20 has a series of channels at different levels within which the in-turned end 90 of wire 84 moves by means of ramps as the bolt moves between the three described positions. There is a first channel portion 94. The wire end 90 is located to the rear of channel portion 94 when the bolt is in the fully extended position. Channel portion 94 is connected by a ramp 96 to a second channel portion 98 at a different level from channel portion 94 and within which the wire end 90 is positioned when the bolt is in the fully retracted position. Intermediate ramp 96 and channel portion 98 there is a small wall 100 which directs the wire end 90 upwardly toward a retaining groove 102, which groove is located intermediate the channel portions 94 and 98 and has a level lower than portion 98. There is a wall 104 which directs the wire end 90 from groove 102 up toward a channel portion 106 at a lower level from portion 102 and within which the wire end 90 moves when the bolt is moving from the partially extended position into the fully open position. A ramp 108 and a wall 110 complete the channel, bringing the wire end 90 back into channel portion 94 as the bolt moves to the fully extended position.

Assuming the bolt is in a fully extended position, wire end 90 will be positioned to the rear of channel portion 94. The bolt will be held in this position by the spring 26 which urges the swivel in a counterclockwise direction. Upon insertion of a key into the swivel, and turning the swivel in a clockwise direction, the bolt will be moved inwardly and wire end 90 will move through channel portion 94, up ramp 96, past wall 100 and into channel portion 98. The bolt is now in a fully retracted position. When the swivel is released, spring 26 will cause the swivel to move in a counterclockwise direction, causing the bolt to move outwardly. As the bolt so moves, the wire end 90 will be directed by wall 100 to a position in which it is caught in groove 102. When the wire is so positioned, the bolt is held in the partially extended position in which the tapered walls 82 extend beyond the end of face plate 10.

When the door is closed and the nose of the bolt makes contact with the door strike, the bolt will be forced inwardly. As it so moves, wall 104 directs the end 90 of wire 84 upwardly into channel portion 106. There is now nothing to prevent the bolt from being fully extended. As the bolt moves to a fully extended position, wire end 90 will move in channel portion 106, down ramp 108, past wall 110, through channel portion 94, and to the location where the wire end 90 was positioned prior to the start of the described cycle of operation. As indicated above, there is slight pressure applied to the wire by the arm 80 of backset clip 66 which pressure insures that the wire will follow the described path along the various channel portions and ramps.

The channels in the side of the bolt and the wire 84 provide a release mechanism which functions to hold the bolt in a partially extended position after it has been moved to a fully retracted position by the use of a key, if a swivel is the lock element, or by the use of some other bolt moving element, depending upon the type of lock structure. Contact of the partially extended bolt with the door strike drives the bolt inwardly, causing release of the mechanism which holds the bolt in the partially extended position and releasing the bolt for movement, under the force of spring 26, to the fully extended position.

The existing automatic deadbolts which are on the market utilize a separate trigger. The present invention utilizes a partially extended deadbolt as the means for causing the deadbolt to be triggered toward a fully extended position. The deadbolt will automatically extend when the door is closed and the partially extended deadbolt contacts the door strike. Whenever the bolt is retracted, it will first move to a fully retracted position and then upon urging from the spring surrounding the swivel will move to the partially extended position. In addition to providing an automatic deadbolt, the invention includes the provision for backset adjustment. Backset can be adjusted between the described limits by the release of the backset clip 66 by use of arm 74. There is further cooperation between the backset clip 66 and the release mechanism, as the clip provides the bias to hold the release wire in contact with the channels and ramps which function to control movement of the bolt between the three described positions.

Whereas the preferred form of the invention has been shown and described herein, it should be realized that there may be many modifications, substitutions and alterations thereto.

The embodiments of the invention in which an exclusive property or privilege is claimed are defined as follows:

1. An automatic door latch having a case, a bolt movable within said case between a fully extended position in which said bolt extends forwardly of said case, a fully retracted position in which said bolt is within said case, and a partially extended position in which said bolt is positioned to contact a door strike, spring means urging said bolt toward an extended position, bolt operating means for moving said bolt, against said spring means, from the fully extended position toward a retracted position, and a release mechanism for holding said bolt in said partially extended position, said release mechanism including means for releasing said bolt for movement by said spring means, to a fully extended position, upon inward movement of said bolt when in the partially extended position, said release mechanism including a release element connected to said case and channel means on said bolt positioned to coact with said release element, said release element having a portion thereof movable in said channel means to provide for bolt movement between said fully extended position and said fully retracted position and for holding said bolt in said partially extended position.

2. The automatic door latch of claim 1 characterized in that said release element is pivotally mounted on said case and extends into said channel means.

3. The automatic door latch of claim 2 characterized in that said release element is elongated and has a portion remote from the pivotal case mounting which extends through said case into contact with said channel means.

4. The automatic door latch of claim 3 characterized in that said release element is a wire.

5. The automatic door latch of claim 4 characterized in that said case has an elongated opening for movement of said wire during movement of said bolt between said fully extended position, said fully retracted position, and partially extended position.

6. The automatic door latch of claim 1 characterized in that said channel means includes a first portion which receives said release element during bolt movement from a fully extended position to a fully retracted position, a second portion which receives said release element when said bolt is in a partially extended position, and a third portion which receives said release element as said bolt moves from said partially extended position to said fully extended position.

7. The automatic door latch of claim 6 characterized in that said first and third channel portions are generally parallel, with said second portion being spaced intermediate thereof.

8. The automatic door latch of claim 7 characterized in that said second portion is formed and adapted to allow said release element to hold said bolt until released by inward movement of said bolt.

9. The automatic door latch of claim 8 characterized by and including ramp means for directing said release element from said first portion to said second portion.

10. The automatic door latch of claim 9 characterized by and including ramp means for directing said release element from said second portion to said third portion.

11. The automatic door latch of claim 1 characterized in that said bolt operating means includes a swivel mounted in said case for turning movement, means connecting said swivel to said bolt.

12. The automatic door latch of claim 11 characterized in that the means connecting said swivel and said bolt include a link pivotally attached to said swivel and attached to said bolt for pivotal and translational movement relative thereto.

13. The automatic door latch of claim 11 characterized in that said spring means is positioned about said swivel and urges said swivel toward a fully extended bolt position.

14. The automatic door latch of claim 13 characterized in that said spring means is a coil spring having one portion in contact with said swivel and another portion in contact with said case.

15. The automatic door latch of claim 11 characterized in that said swivel is movable relative to the forward end of said case for adjusting backset between defined backset adjustment limits.

16. The automatic door latch of claim 15 characterized by and including a releasable fastener for holding said swivel in a defined backset adjustment position.

17. A door latch having a case assembly including a front case and a rear case telescopically movable relative thereto, a bolt movable in said case assembly between an extended position in which the bolt extends a determined distance forwardly of said front case and a retracted position in which said bolt is within said case assembly, a swivel mounted in said rear case for turning movement, means connecting said swivel and bolt whereby turning movement of said swivel moves said bolt between said extended and retracted positions, said front and rear cases being relatively movable between two backset adjustment positions, a slot in said rear case, and a releasable fastener attached to said front case and having a projection extending into said rear case slot for holding said front and rear cases in an adjustable backset position, said fastener having an exterior arm, movement of which releases said projection from said rear case slot permitting relative movement between said front and rear cases.

18. The door latch of claim 17 characterized by a link connecting said swivel and bolt, cooperating means on said link, bolt and front case for holding said bolt in a fully extended position, resisting inward movement thereof except by turning of said swivel.

19. The door latch of claim 18 characterized in that said rear case slot has enlarged portions at opposite ends thereof which coact with said fastener to hold said front and rear cases in either of said two backset adjustment positions.

* * * * *